FIP8102 XR 4,194,088

United States Patent [19]

Streeter

[11] 4,194,088

[45] Mar. 18, 1980

[54] MODULATION MONITOR FOR AM STEREOPHONIC BROADCASTS

[75] Inventor: Robert D. Streeter, Fort Wayne, Ind.

[73] Assignee: The Magnavox Company, Fort Wayne, Ind.

[21] Appl. No.: 886,707

[22] Filed: Mar. 15, 1978

[51] Int. Cl.[2] ..... H04H 5/00

[52] U.S. Cl. ..... 179/1 GS; 455/67

[58] Field of Search ..... 179/1 GS, 1 GD; 325/67, 325/36

[56] References Cited

U.S. PATENT DOCUMENTS

| | | | |
|---|---|---|---|
| 2,403,385 | 7/1946 | Loughlin | 179/1 GS |
| 3,068,475 | 12/1962 | Avins | 325/36 |
| 3,148,342 | 9/1964 | Holt | 179/1 GS |
| 3,218,393 | 11/1965 | Kahn | 325/36 |
| 3,360,729 | 12/1967 | Palatinus | 325/67 |
| 3,531,722 | 9/1970 | Seibold | 325/67 |
| 3,908,090 | 9/1975 | Kahn | 179/1 GS |

*Primary Examiner*—Douglas W. Olms

*Attorney, Agent, or Firm*—Thomas A. Briody; William J. Streeter; Simon L. Cohen

[57] ABSTRACT

Apparatus is described for removing stereophonic signals contained in a broadcast signal. Removal of a stereophonic indicator tone frequency on the broadcast signal is also provided. Separate outputs measuring both a summation signal of left plus right audio signals and a difference signal of left minus right audio signals are provided. Matrix means are also included for separating left audio signal and right audio signal from the summation and difference signals. These recovered audio signals may be monitored by standard broadcast instruments to observe the performance level of the broadcast signal.

2 Claims, 1 Drawing Figure

MODULATION MONITOR FOR AM STEREOPHONIC BROADCASTS

BACKGROUND OF THE INVENTION

The apparatus of the invention deals with stereophonic broadcast transmission equipment. More specifically, a monitor is provided for detecting the stereophonic information contained on a broadcast signal.

Stereophonic transmission on a radio broadcast signal is known in the art. Broadcasts at the high frequency FM spectrum have been conducted for a number of years carrying two channels of information. The two channels of information when detected by an FM receiver properly equipped with demodulation circuitry produces left and right outputs of stereophonic information. Recently, a number of systems have been proposed for transmitting stereophonic information on low frequency signals now carrying monophonic transmissions in the AM broadcast band.

Commercial broadcasters carrying either FM transmission of stereophonic information or the proposed AM stereophonic transmissions require monitoring the transmitted signal to insure a quality consistent with Federal Communications Commission standards and acceptable to the listening audience. Therefore, it is necessary for each broadcaster of stereophonic information to monitor the signal which is being broadcast to insure all broadcast requirements are being met, both legal and publicly acceptable standards.

Therefore, future AM stereophonic broadcasts will require monitor equipment at the broadcast station in order to measure the quality of the AM stereophonic broadcast. Distortion, intermodulation, frequency response, crossover, and other parameters controlled by the Federal Communications Commission and performance levels expected by the public listening audience will need to be verified. The present invention seeks to provide monitor signals from the broadcasted AM stereophonic signal in order for stations to meet its legal and commercial obligations.

SUMMARY OF THE INVENTION

It is an object of this invention to provide signals for monitoring the quality of AM stereophonic broadcasts.

It is also an object of this invention to provide a monitor which is relatively frequency insensitive and may be implemented to monitor a number of broadcast frequencies.

These and other objects are provided by the apparatus of this invention. A sample signal of the broadcasted stereophonic signal is detected and the stereophonic signals removed from the broadcast signal. Once having removed the information contained within the stereophonic broadcast signal, an analysis of the recovered audio signal can be made on conventional laboratory equipment. The present invention will remove from the sample broadcast signal a stereophonic indicator tone which may be phase or frequency modulated on the signal. Removal of the tone will thereby permit analysis of the audio information contained in the broadcast signal.

DESCRIPTION OF THE PREFERRED EMBODIMENT

Figure 1:
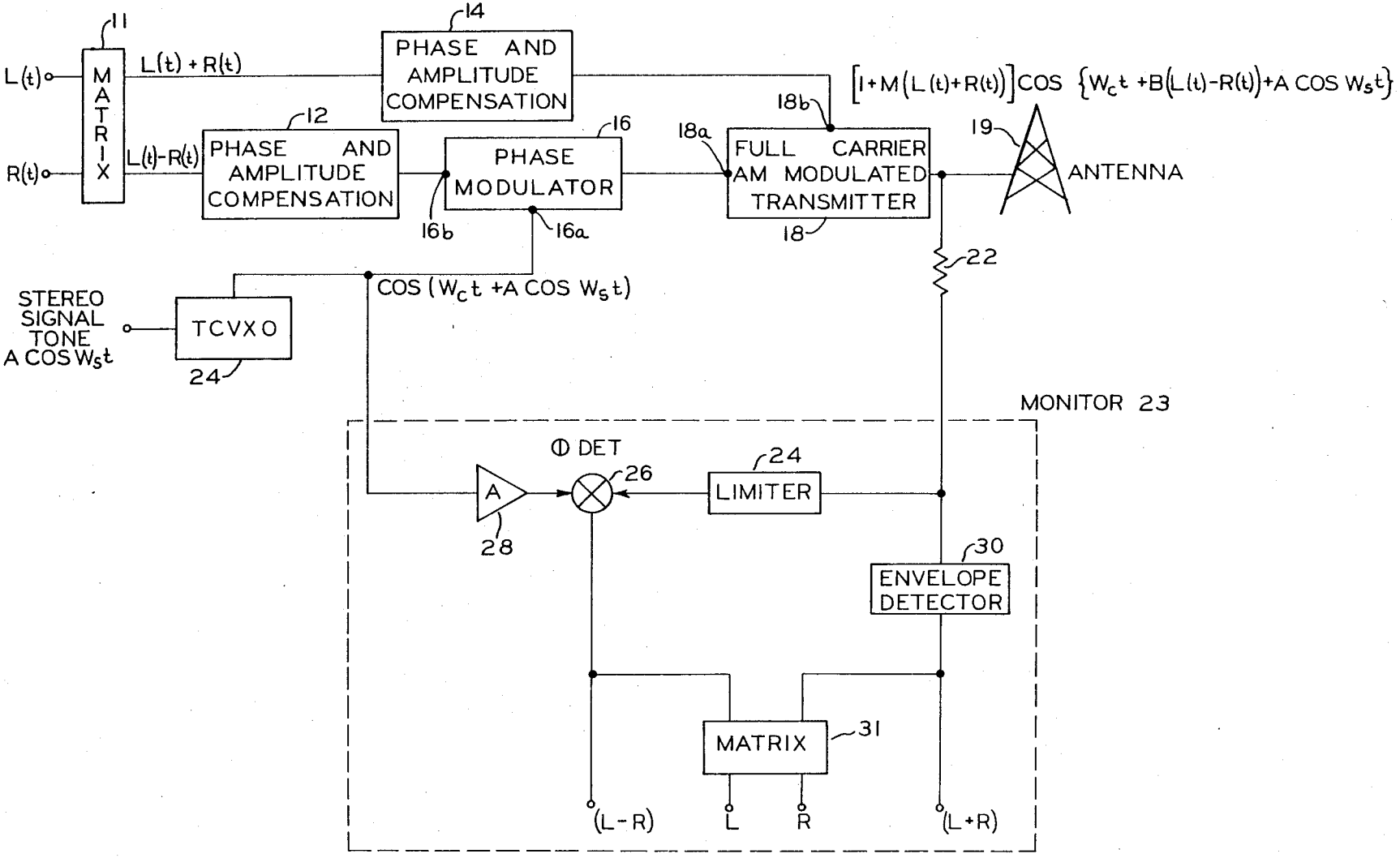
FIG. 1 is an illustration of one embodiment of the present invention operatively connected to an AM stereophonic broadcast transmitter.

Referring now to FIG. 1, there is shown an embodiment of this invention operatively connected to an AM stereophonic broadcast transmitter. The transmitter is more particularly described in a patent application, Ser. No. 779,392, filed Mar. 21, 1977, in the name of Robert D. Streeter, entitled "LOW FREQUENCY AM STEREOPHONIC BROADCAST AND RECEIVING APPARATUS", hereby incorporated by reference. The monitor will extract both channels of information for measuring such parameters as distortion, intermodulation, frequency response, and other signal conditions which relate to signal fidelity.

The transmitter shown in FIG. 1 has a carrier frequency of Wc. The carrier frequency Wc is generated by a temperature compensated crystal oscillator, hereinafter referred to as a TCVXO, 24. The TCVXO may be frequency modulated whereby a low frequency signal tone $ACOSW_st$ may cause the carrier frequency to be deviated at a sub-audio rate. In one embodiment of the invention a 5 cycle sinusoidal tone was employed to produce a frequency deviation of 20 cps.

The carrier frequency signal $COS(w_ct)$ modulated by a stereo tone of an $ACOS(W_st)$ is described as follows:

$$COS(W_ct+ACOSW_st)$$

This modulated carrier frequency signal is applied to a phase modulator 16. Phase modulator 16 further modulates the carrier frequency signal in phase, rather than frequency. The phase modulator may be of the phase lock loop type described in the aforementioned patent application.

The signals for phase modulating the carrier frequency are derived from two channels of information designated, left and right. These two channels of information, hereafter referred to as L(t) and R(t), are applied to a matrix 11. The matrix 11 produces a sumation signal, L(t)+R(t) and a difference signal L(t)−R(t). The sumation and difference signals are applied to phase and amplitude compensation networks 12 and 14. These networks are intended to compensate for any phase or amplitude nonlinearity suffered by the sum and difference signals in the modulation and transmission process. Those skilled in the art will recognize that these networks are merely to compensate for nonlinearities present in the modulation and transmission components in a broadcast system. The compensated difference signal supplied by network 12 is applied to the modulation input **16*b* of a phase modulator 16. The carrier frequency generated by TCVXO 24 is applied to the input terminal 16*a* of phase modulator 16**. The difference signal phase modulates the carrier frequency signal at a peak deviation of 1 radian. The resulting signal is described below as follows:

$$COS[W_ct+B(L(t)-R(t))+A\ COS\ W_st]$$

This signal contains a frequency modulated component, $ACOSW_st$ as well as a phase modulated component B(L(t)−R(t)). The phase of the carrier is linearly modulated with this difference signal. Linear modulation techniques are described more particularly in the aforementioned patent application. Phase lock loop modulators consisting of a phase detector, voltage controlled oscillator, and filter may be implemented to provide linear phase modulation of the carrier with the difference signal. B is selected so that the peak deviation is 1 radian.

The resulting frequency and phase modulated carrier frequency signal is applied to the carrier imput 18*a* of a full carrier AM modulated transmitter 18. The transmitter 18 amplifies the phase modulated carrier frequency signal, and further amplitude modulates the carrier frequency signal with the compensated summation signal, L(t)+R(t) supplied to modulation input 18*b*. The transmitter produces two sets of sidebands for broadcast, one resulting from the difference signal phase modulation and one resulting from the summation signal amplitude modulation.

The monitor circuit 23 removes the summation and difference signals from the broadcast apparatus output signal to produce the L(t) and R(t) signals. The signal is coupled by coupling means 22 shown as a resistor to a limiter 24 and envelope detector 30. The limiter 24 and emvelope detector 30 are designed with a minimum of AM to PM conversion and PM to AM conversion. Also, it is desirable to have a bandwidth for these devices which covers the entire broadcast band. The signal provided by the coupling means is a sample of the output signal supplied to the antenna 19. This sample signal is limited by limiter 24 to remove the amplitude modulation applied by the full carrier AM modulated transmitter 18. The signal from limiter 24 is applied to an input of phase detector 26. The input signal comprises the phase modulated and frequency modulated components of the broadcast signal. A portion of the TCVXO 24 signal comprising the frequency modulated carrier frequency is supplied to an amplifier 28. Amplifier 28 will increase this signal to a magnitude corresponding to the limiter output signal. The amplifier 28 output signal is applied to a second input of phase detector 26. Phase detector 26 will provide a signal proportional to the difference modulation signal, L(t)−R(t). The difference signal is applied to a matrix 31.

An envelope detector 30 produces a signal proportional to the summation signal contained within the carrier envelope of the broadcast signal. This detected signal, proportional to the summation signal, L(t)+R(t), is also applied to matrix 31. Matrix 31 combines the two input signals to provide L(t) and R(t) signals. These respective signals L+R, L−R, L, and R, are thereafter monitored to determine the various stereophonic parameter specified by the Federal Communications Commission Rules and the public audience acceptability standards. The apparatus described is relatively insensitive to the carrier frequency and therefore may be used to monitor any of the frequencies provided.

Thus there has been described with respect to a specific embodiment an example of the present invention defined more specifically by the claims that follow.

What is claimed is:

1. In a system for broadcasting a stereophonic signal comprising a phase modulator for linearly phase modulating a carrier frequency signal with a difference signal, L(t)−R(t), said carrier frequency signal being previously frequency modulated with a low frequency signal tone; a full carrier double sideband amplitude modulator for modulating said phase modulated carrier frequency signal with a summation signal L(t)+R(t) whereby said stereophonic broadcast signal is produced, a monitor for removing said summation and difference signal from said stereophonic signal comprising:

a. a phase detector means for combining two frequency identical signals and for producing a difference signal;

b. a limiter adaptively coupled to receive said broadcast signal, said limiter providing one of said two frequency identical signals in the form of a substantially amplitude constant signal to said detector;

c. means for providing a representative sample of said frequency modulated carrier frequency as the other of said two frequency identical signals to said detector, said sample having a magnitude substantially equal to said limiter signal;

d. an envelope detector adaptively coupled to receive said broadcast signal, said envelope detector providing a signal proportional to variations in the amplitude of said broadcast signal; and e. matrix means for combining said envelope detector output signal with said phase detector output signal whereby said L(t) and R(t) signals are produced.

2. A method for providing monitor signals from an AM stereophonic broadcast signal, said signal comprising a carrier frequency signal being modulated in phase with a first channel of information and subsequently modulated in amplitude with a second signal comprising:

a. supplying a sample of said carrier frequency signal to one input of a phase detector;

b. amplitude limiting a portion of said broacast signal;

c. combining said amplitude limited signal with said sample of said carrier frequency signal in said phase detector whereby said first channel of information is provided; and d. detectng the envelope of said broadcast signal to provide a signal proportional to the amplitude changes in said broadcast signal to produce a second channel of information.

* * * * *